US008096305B1

(12) United States Patent
Cheney

(10) Patent No.: US 8,096,305 B1
(45) Date of Patent: Jan. 17, 2012

(54) NAIL CLIPPER AND LIGHT COMBINATION ASSEMBLY

(76) Inventor: Tanya L. Cheney, Largo, FL (US)

( * ) Notice: Subject to any disclaimer, the term of this patent is extended or adjusted under 35 U.S.C. 154(b) by 159 days.

(21) Appl. No.: 12/579,543

(22) Filed: Oct. 15, 2009

(51) Int. Cl.
*A45D 29/18* (2006.01)
*A45D 29/00* (2006.01)

(52) U.S. Cl. ..... 132/73.5; 132/75.4; 30/29; 30/26

(58) Field of Classification Search ..... 132/73.5, 132/73, 73.6, 75.4, 75.5; 30/26–28, 29; 362/119
See application file for complete search history.

(56) References Cited

U.S. PATENT DOCUMENTS

| | | | | |
|---|---|---|---|---|
| 804,426 | A * | 11/1905 | Mullen | 30/251 |
| 5,775,340 | A * | 7/1998 | Rains | 132/73.5 |
| 6,220,251 | B1 * | 4/2001 | Jeong et al. | 132/73.5 |
| 6,553,592 | B2 | 4/2003 | Yang et al. | |
| D507,077 | S | 7/2005 | Kearson et al. | |
| 7,131,448 | B2 | 11/2006 | Lund et al. | |
| 7,137,356 | B2 | 11/2006 | Huggans | |
| 7,217,001 | B2 | 5/2007 | Vrsalovic et al. | |
| 7,263,775 | B2 | 9/2007 | Moulton, III | |
| 7,575,335 | B2 * | 8/2009 | Neal et al. | 362/119 |

OTHER PUBLICATIONS

Derwent 2008-D67046, Ding H Wei, Self-lighting nail clippers, Aug. 22, 2007.*

* cited by examiner

*Primary Examiner* — Robyn Doan

(57) ABSTRACT

A nail clipper and light combination assembly includes a clipper that has a first arm with a first end and a second end and a second arm with a first end and a second end. The first ends of the first and second arms are attached together. The clipper includes a pair of blades and each of the second ends has one of the blades attached thereto. The blades extend toward each other. The second ends are biased away from each other. A lever is mechanically coupled to the first and second arms. The lever has a free end that is movable toward the first and second arms to urge the blades together in a cutting motion. A light emitter is attached to the clipper to emit light toward the second ends from above the first arm when the light emitter is turned on.

4 Claims, 4 Drawing Sheets

NAIL CLIPPER AND LIGHT COMBINATION ASSEMBLY

BACKGROUND OF THE DISCLOSURE

1. Field of the Disclosure

The disclosure relates to nail clipper devices and more particularly pertains to a new nail clipper device for emitting light on a person's finger and the clipper while the person is cutting their nails.

2. Summary of the Disclosure

An embodiment of the disclosure meets the needs presented above by generally comprising a clipper that has a first arm with a first end and a second end and a second arm with a first end and a second end. The first ends of the first and second arms are attached together. The clipper includes a pair of blades and each of the second ends has one of the blades attached thereto. The blades extend toward each other. The second ends are biased away from each other. A lever is mechanically coupled to the first and second arms. The lever has a free end that is movable toward the first and second arms to urge the blades together in a cutting motion. A light emitter is attached to the clipper to emit light toward the second ends from above the first arm when the light emitter is turned on.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
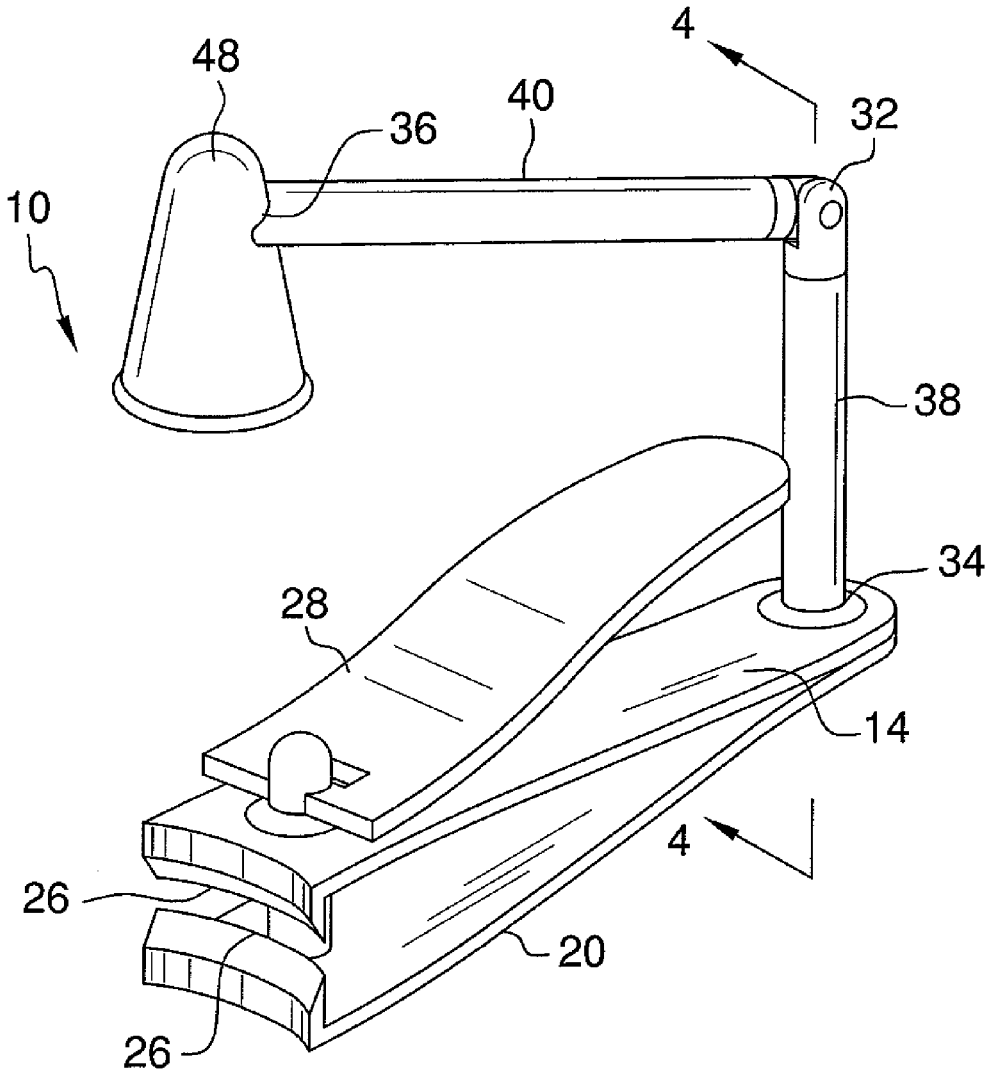
FIG. 1 is a front perspective view of a nail clipper and light combination assembly according to an embodiment of the disclosure.
Figure 2:
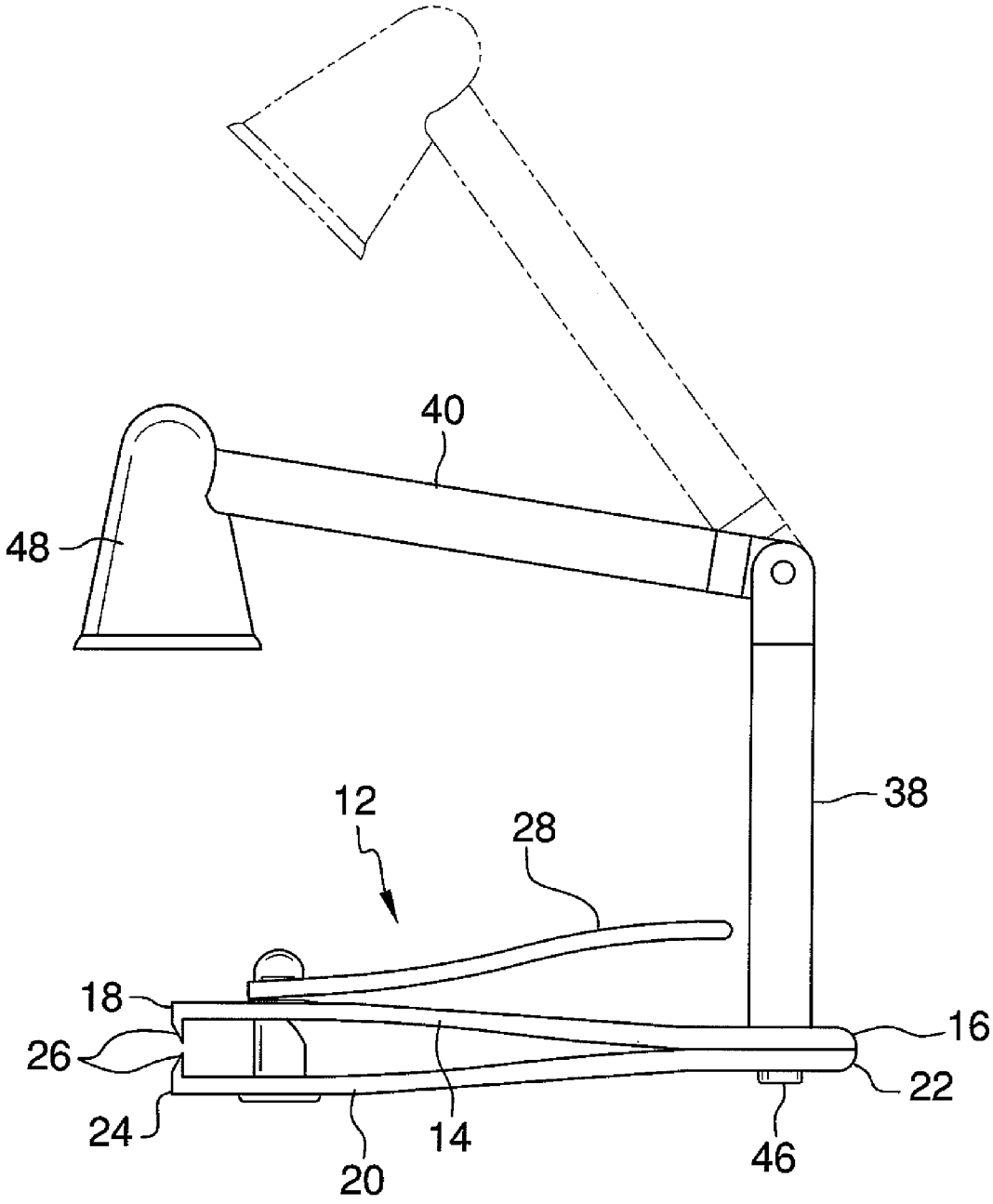
FIG. 2 is a side view of an embodiment of the disclosure.
Figure 3:
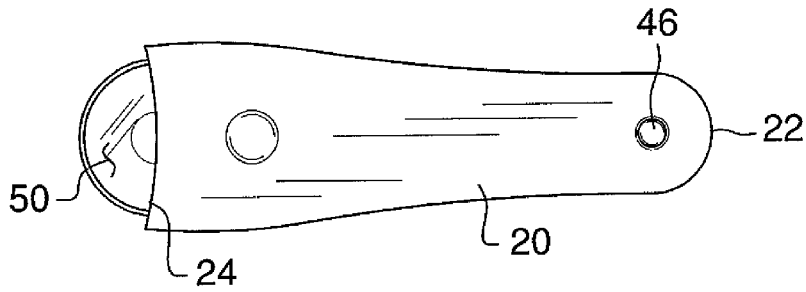
FIG. 3 is a bottom view of an embodiment of the disclosure.
Figure 4:
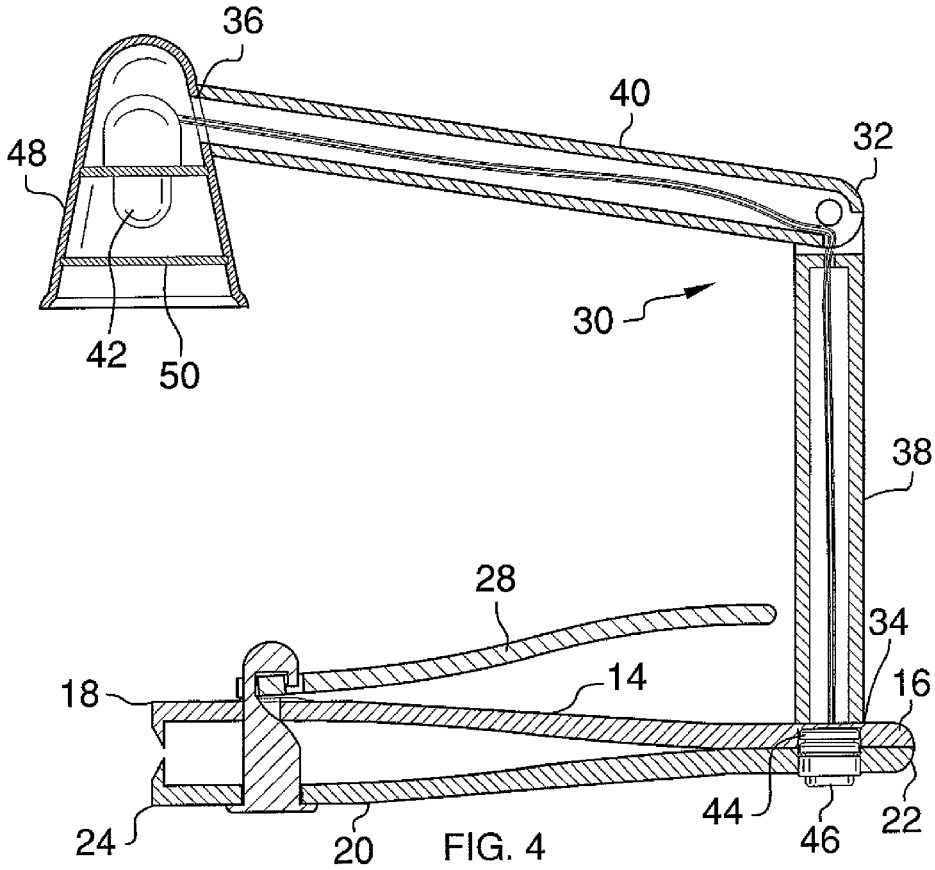
FIG. 4 is a cross-sectional view taken along line 4-4 of FIG. 1 of an embodiment of the disclosure.
Figure 5:
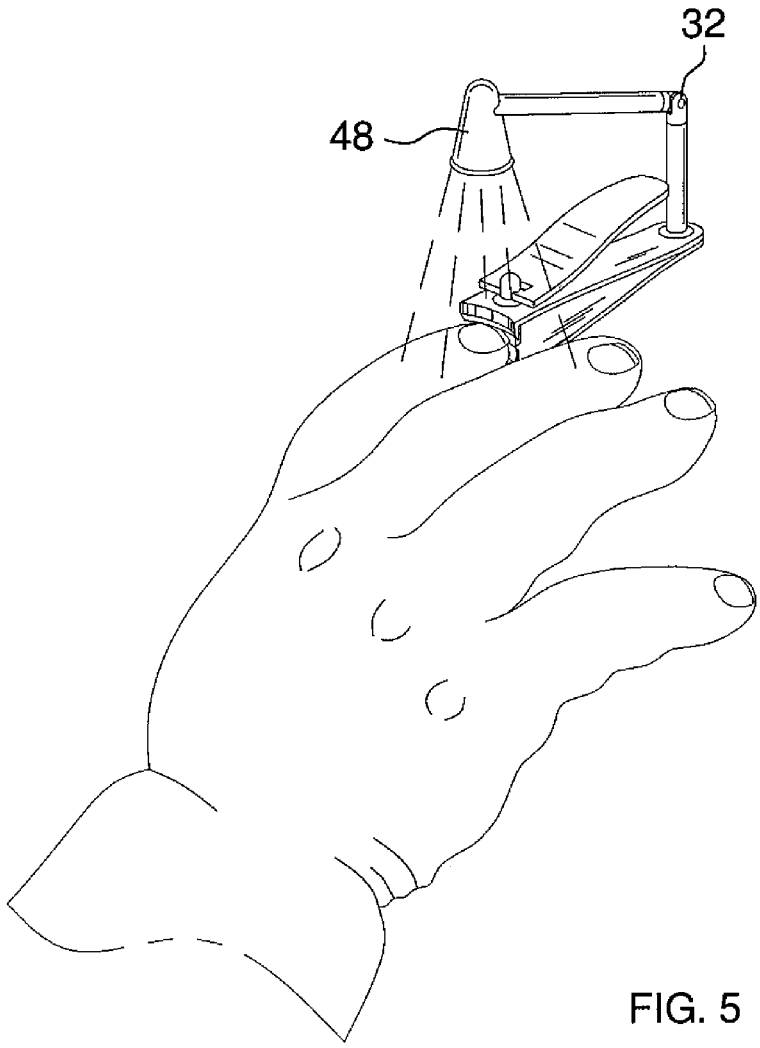
FIG. 5 is a perspective in-use view of an embodiment of the disclosure.

With reference now to the drawings, and in particular to FIGS. 1 through 5 thereof, a new nail clipper device embodying the principles and concepts of an embodiment of the disclosure and generally designated by the reference numeral 10 will be described.

As best illustrated in FIGS. 1 through 5, the nail clipper and light combination assembly 10 generally comprises a clipper 12 that has a first arm 14 with a first end 16 and a second end 18 and a second arm 20 with a first end 22 and a second end 24. The first ends 16, 22 of the first 14 and second 20 arms are attached together. The clipper 12 includes a pair of blades 26. Each of the second ends 18, 24 has one of the blades 26 attached thereto. The blades 26 extend toward each other. The second ends 18, 24 are biased away from each other by bends in the first 14 and second 20 arms as the first 14 and second 20 arms are comprised of a resiliently bendable material. A lever 28 is mechanically coupled to the first 14 and second 20 arms. The lever 28 has a free end 30 that is movable toward the first 14 and second 20 arms to urge the blades 26 together in a cutting motion. The clipper 12 generally comprises a conventional nail clipper in terms of structure and function.

A light emitter 30 is attached to the clipper 12. The light emitter 30 emits light toward the second ends 18, 24 when the light emitter 30 is turned on. The light emitter 30 includes a post 32 that has an attached end 34 attached to the first arm 14. The post 32 has a distal end 36 with respect to the attached end 34. The post 32 includes a first section 38 and a second section 40 pivotally coupled together to allow the distal end 36 to be moved with respect to the clipper 12. The attached end 34 is positioned adjacent to the first end 16 of the first arm 14 and extends upwardly from the first arm 14, approximately perpendicular to a longitudinal axis of the clipper 12 extending through points between the first 16, 22 and second 18, 24 ends, to position the first arm 14 between first section 38 of the post 32 and the second arm 20. The second section 40 extends toward the second end 18 of the first arm 14. This allows the distal end 36 to be moved closed to or further away from second end 18 of the first arm 14 by tilting upwardly or downwardly with respect to the first arm 14.

The light emitter 30 further includes a light emitting diode 42 that is attached to the distal end 36 of the post 32. A battery 44, which may include one or more batteries, is electrically coupled to the light emitting diode 42 to supply electricity to the light emitting diode 42. An actuator 46 is operationally coupled to the light emitting diode 42 to turn the light emitting diode 42 on or off. The actuator 46 is mounted on the bottom side of the second arm 20 adjacent to the first end 22 thereof and opposite the post 32. The actuator 46 may be a pressure sensitive actuator so that as a person holds the clipper 12, the actuator 46 is engaged to turn on the light emitting diode 42. The positioning of the actuator 46 ensures that it will be actuated by a person's finger as they use the clipper 12. A shroud 48 may be attached to the post 32 and extends over the light emitting diode 42 to direct light from the light emitting diode 42 downwardly toward the clipper 12. A lens 50 may be mounted in the shroud 48 to focus the light emitted by the light emitting diode 42.

In use, the clipper 12 is used in a conventional manner to clip a person's fingernails or toenails. However, the light emitter 30 assists a person in better seeing their nails and the clipper 12 so that the clipper 12 may be used in low light or by person with impaired vision.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A nail cutting assembly comprising:

a clipper having a first arm having a first end and a second end and a second arm having a first end and a second end, said first ends of said first and second arms being attached together, said clipper including a pair of blades, each of said second ends having one of said blades attached thereto, said blades extending toward each other, said second ends being biased away from each other, a lever being mechanically coupled to said first and second arms, said lever having a free end being movable toward said first and second arms to urge said blades together in a cutting motion; and a light emitter being attached to said clipper, said light emitter emitting light toward said second ends from above said first arm when said light emitter is turned on, said light emitter including:

a post having an attached end being attached to said first arm, said post having a distal end with respect to said attached end, said post including a first section and a second section pivotally coupled together to allow said distal end to be moved with respect to said clipper;

a light emitting diode being attached to said distal end of said post;

a battery being electrically coupled to said light emitting diode to supply electricity to said light emitting diode; and an actuator being operationally coupled to said light emitting diode to turn said light emitting diode on or off.

2. The assembly according to claim 1, wherein said attached end is positioned adjacent to said first end of said first arm and extends upwardly from said first arm to position said first arm between first section of said post and said second arm, said second section extending toward said second end of said first arm.

3. The assembly according to claim 1, further including a shroud being attached to said post and extending over said light emitting diode to direct light from said light emitting diode downwardly toward said clipper.

4. A nail cutting assembly comprising:

a clipper having a first arm having a first end and a second end and a second arm having a first end and a second end, said first ends of said first and second arms being attached together, said clipper including a pair of blades, each of said second ends having one of said blades attached thereto, said blades extending toward each other, said second ends being biased away from each other, a lever being mechanically coupled to said first and second arms, said lever having a free end being movable toward said first and second arms to urge said blades together in a cutting motion;

a light emitter being attached to said clipper, said light emitter emitting light toward said second ends when said light emitter is turned on, said light emitter including:

a post having an attached end being attached to said first arm, said post having a distal end with respect to said attached end, said post including a first section and a second section pivotally coupled together to allow said distal end to be moved with respect to said clipper, said attached end being positioned adjacent to said first end of said first arm and extending upwardly from said first arm to position said first arm between first section of said post and said second arm, said second section extending toward said second end of said first arm;

a light emitting diode being attached to said distal end of said post;

a battery being electrically coupled to said light emitting diode to supply electricity to said light emitting diode;

an actuator being operationally coupled to said light emitting diode to turn said light emitting diode on or off; and a shroud being attached to said post and extending over said light emitting diode to direct light from said light emitting diode downwardly toward said clipper.

* * * * *